United States Patent [19]

Fuse

[11] 4,246,821

[45] Jan. 27, 1981

[54] ELECTRIC FOOD SLICER

[75] Inventor: Michio Fuse, Nagoya, Japan

[73] Assignee: Kabushikikaisha Aichidenkikosakusho, Japan

[21] Appl. No.: 34,799

[22] Filed: Apr. 30, 1979

[30] Foreign Application Priority Data

Aug. 8, 1978 [JP] Japan ..... 53-96854

[51] Int. Cl.[3] ..... B26D 4/28

[52] U.S. Cl. ..... 83/707; 83/571; 83/859

[58] Field of Search ..... 83/703, 707, 729, 730, 83/859, 571

[56] References Cited

FOREIGN PATENT DOCUMENTS

| | | | |
|---|---|---|---|
| 2345688 | 3/1975 | Fed. Rep. of Germany | 83/703 |
| 2544276 | 4/1977 | Fed. Rep. of Germany | 83/729 |
| 2629352 | 1/1978 | Fed. Rep. of Germany | 83/730 |
| 2241961 | 3/1975 | France | 83/707 |

*Primary Examiner*—J. M. Meister
*Attorney, Agent, or Firm*—William A. Drucker

[57] ABSTRACT

An electric food slicer includes a cutter rotated by an electric motor. The motor is housed in a motor housing removably received in the main body, so that the motor is not actuated unless the motor housing is in the main body. A support for supporting a slice plate thereon is removably attached to the main body and is rotatable when not in use into an inoperative position in close proximity to the main body without being disconnected therefrom. A food clamp is removably supported on the slice plate. All these parts of the slicer can be held together in a compact shape around the main body for the storage or packing of the slicer. An electric cord connected to the motor can be held in a compact shape in the slice plate support. All the parts including the main body, except the motor housing, can be easily detached from one another and washed in a usual way to keep the machine in a sanitary condition.

5 Claims, 12 Drawing Figures

ELECTRIC FOOD SLICER

BACKGROUND OF THE INVENTION

1. Field of the Invention

This invention relates to an improvement in an electric food slicer.

2. Description of the Prior Art

An electric food slicer of this sort usually includes a main body, and a disc-shaped cutter provided on the front face of the main body and connected to an electric motor for rotation therewith. A plate support horizontally projects from the lower end of the front face of the main body. A slice plate is transversely movably supported on the plate support. A food clamp is longitudinally movably placed on the slice plate. The food to be sliced is placed on the slice plate and pressed against the front face of the main body by the food clamp. The slice plate is, then, moved toward the cutter, whereby the food is sliced.

The plate support projecting from the front face of the main body presents undesirable problems in the packing and storage of the food slicer because it occupies a large space or volume. In order to provide a solution to these problems, there has been proposed a food slicer having a plate support rotatably attached to the front face of the main body for rotation into a retracted position adjacent to the main body when the slicer is not in use. However, the other parts such as the slice plate and the food clamp, are not integrally connected with the main body, but must be separated therefrom for storage of the machine when it is not in use. Those parts are, therefore, likely to be lost making the machine useless. The parts are likely kept in a box in a random fashion during storage of the machine. The surfaces of the parts which will be brought into direct contact with the food to be sliced are exposed to dust or dirt; this is a serious problem from the sanitary standpoint. The electric cord is also kept in the box in a disorderly fashion and may interfere with the main body or any part of the machine, causing breakage or other damage thereto when they are taken out from the box.

The electric motor mounted within the main body makes it impossible to wash the latter in water. This presents a problem from the sanitary standpoint. The smell of the food previously cut by the machine is likely to remain in the main body and degradate the taste or flavor of another kind of food being sliced.

SUMMARY OF THE INVENTION

This invention provides an improved electric food slicer which is free from the drawbacks hereinabove discussed.

It is an object of this invention to provide an electric food slicer having a main body and all the other essential parts integrally connected with the main body for storage in a compact package when the slicer is not in use.

It is another object of this invention to provide an electric food slicer which permits storage in a sanitary condition with all the parts compactly united to the main body and their food contacting surfaces facing the inside of the machine.

It is still another object of this invention to provide an electric food slicer having an electric cord which can be neatly kept behind a plate support during storage.

It is a further object of this invention to provide an electric food slicer having a motor housing which can be separated from the main body to permit washing of the main body itself.

It is a still further object of this invention to provide an electric food slicer having an electric motor which is not actuated when the motor housing is separated from the main body.

The electric food slicer of this invention essentially comprises a main body, a disc-shaped cutter, a motor housing, a plate support, a slice plate and a food clamp. The cutter is removably mounted on the front face of the main body. The motor housing accommodates an electric motor which rotates the cutter, and is detachably received in the main body. The motor is actuated by a device provided in the main body, so that it is not actuated if the motor housing is detached from the main body.

The plate support is removably attached to the lower end of the front face of the main body. It is rotatable either for horizontal projection from the front face of the main body, or for storage in close proximity to the main body. It is also removable from the main body. The slice plate is transversely movably supported on the plate support. The food clamp is longitudinally movably supported on the slice plate.

All the parts of the machine, except the motor housing, can be washed in a usual way. Most advantageously, the main body can be easily washed to release any undesirable smell and can always be kept in a sanitary condition.

The motor housing can safely be detached from the main body without any danger of unintentional actuation of the motor.

The main body and all the other parts of the machine can be integrally united with one another in a compact shape which is convenient for packing or storage. The plate support is rotated into close proximity to the front face of the main body. The slice plate is held on the outside of the plate support. The food clamp is received in a hollow space behind the main body through which sliced food is discharged. The electric cord is received and held in a neat shape behind the plate support. When the machine is stored, all the food contacting surfaces of its parts face the inside of the machine to maintain it in a sanitary condition until it is put in use again.

It will be understood that this invention provides an improved electric food slicer which is sanitary, safe and convenient for packing and storage.

These and other objects and advantages of this invention will become more apparent from the following detailed description.

DESCRIPTION OF THE PREFERRED EMBODIMENT

Figure 1:
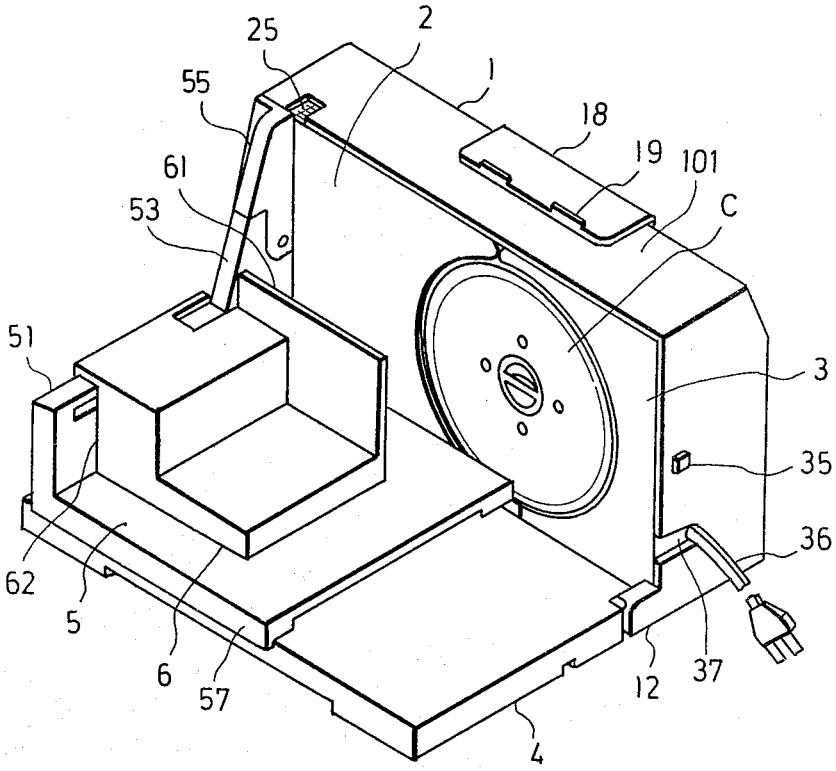
FIG. 1 is a perspective view of an electric food slicer embodying this invention.
Figure 2:
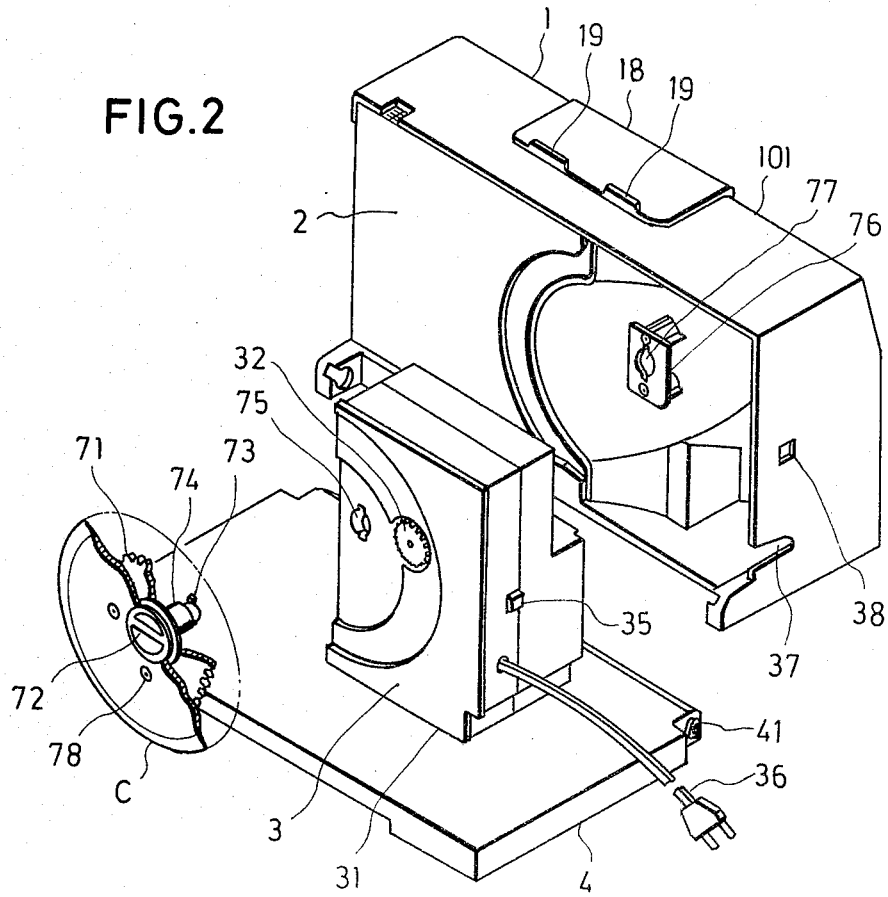
FIG. 2 is an exploded perspective view showing the cutter and the motor housing in their disassembled position.
Figure 3:
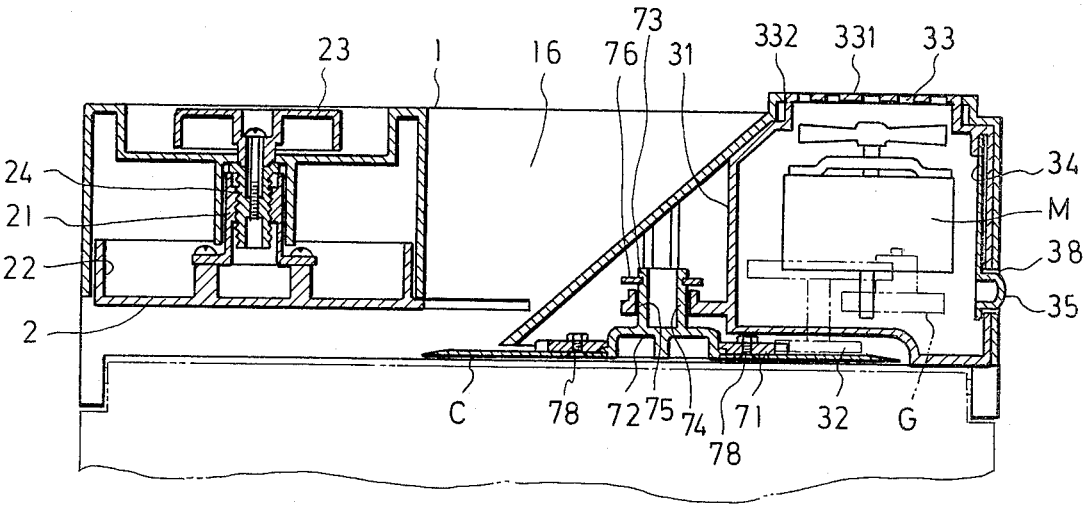
FIG. 3 is a horizontal sectional view showing the internal structure and mechanism of the main body.
Figure 11:
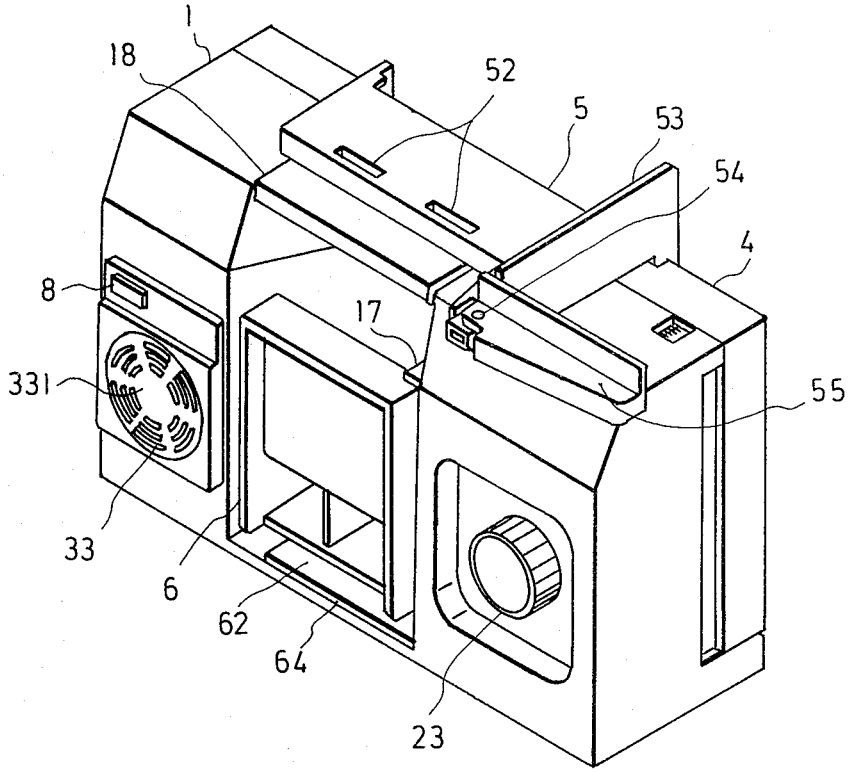
FIG. 11 is a perspective view in rear elevation of the device shown in FIG. 10.

Referring first to FIGS. 1 through 6 of the drawings, the electric food slicer embodying this invention includes a main body 1 made of plastic and provided on its front face with a front face plate 2 adjusting the slicing thickness. The front face plate 2 is shaped like a box formed by a side wall 22 (FIG. 3) and received in the framework of the main body 1. The rear face of the main body 1 is provided with a knob 23 as shown in FIGS. 3 and 11. An internally threaded tubular projection 21 is provided on the inner surface of the front face plate 2 and receives therein an externally threaded bolt 24 projecting from the knob 23, so that rotation of the knob 23 causes movement of the front face plate 2 back and forth. The slicing thickness for food is indicated by a scale 25.

A disc-shaped cutter C is provided beside the front face plate 2. The cutter C is rotatably supported on a fixed shaft 74 which is provided with a knob 72 at its outer end, while the inner end of the shaft 74 is provided with a lug 73. A driven gear 71 is secured to the inner surface of the cutter C by screws 78 to cause rotation of the cutter C.

An electric motor M which rotates the cutter C is accommodated in a motor housing 3 made of plastic. The motor housing 3 is removably attached to the main body 1 as shown in FIG. 2. A driving gear 32 is attached to the front outer surface of the motor housing 3. A reduction gear G in the motor housing 3 provides driving connection between the motor M and the driving gear 32. The driving gear 32 meshes with the driven gear 71 on the cutter C to rotate the cutter C upon operation of the motor M.

The rear wall of the motor housing 3 is provided with a circular ventilation window 331 having ventilation holes 33 as also shown in FIG. 11. Air is circulated through the holes 33 to cool the motor M. The rear wall of the main body 1 is provided with a circular hole 332 in which the ventilation window 331 is received to support the motor housing 3 on the main body 1. The window 331 can be manually pushed apart from the rear wall of the main body 1 to permit detachment of the motor housing 3 from the main body 1.

A leaf spring 34 has one end secured to the inner surface of a side wall of the motor housing 3. The other or free end of the leaf spring 34 is outwardly bent to define a lock button 35 which normally projects outwardly through a hole 38 in a side wall of the main body 1 to lock the motor housing 3 in position when it is placed in the main body 1. The side wall of the main body 1 is also provided with a slit 37 through which an electric cord 36 extends from the motor housing 3 in the main body 1.

Figure 4:
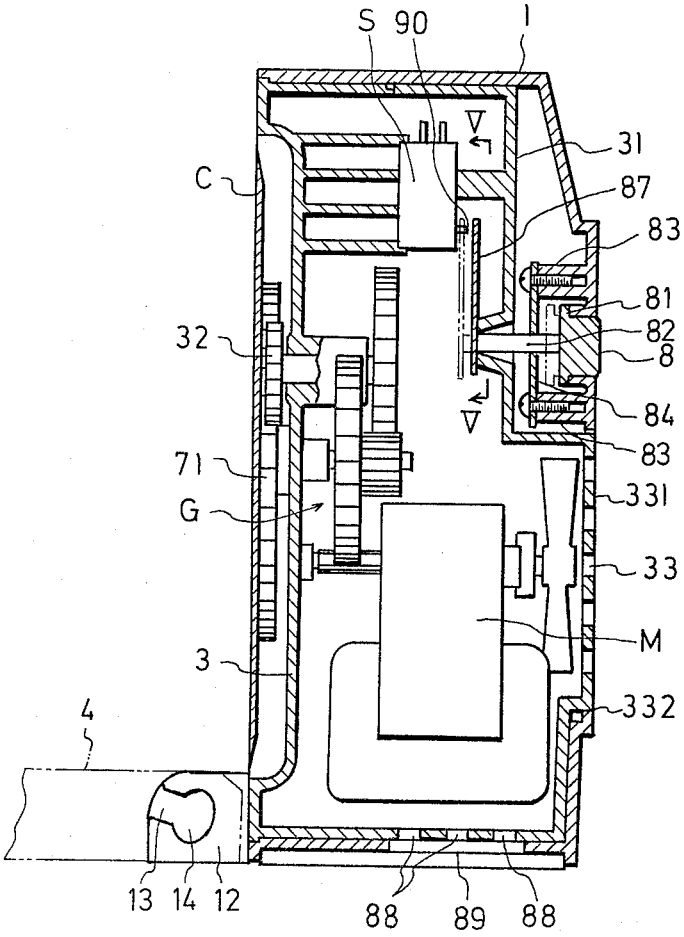
FIG. 4 is a vertical sectional view showing the internal structure of the main body in which the motor housing is accommodated.
Figure 5:
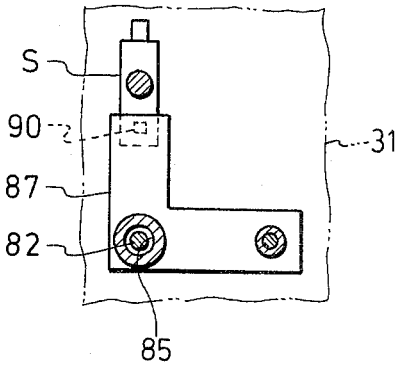
FIG. 5 is a cross-sectional view taken along the line V—V of FIG. 4.
Figure 6:
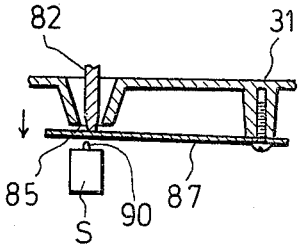
FIG. 6 is a fragmentary vertical sectional view showing the switch actuating mechanism.

The motor housing 3 is provided with a microswitch S for actuating the motor M. A pushbutton 8 is provided on the rear wall of the main body 1 to turn on and off the microswitch S. The pushbutton 8 is formed with a flange 81 at its inner end from which a pin 82 projects. The pin 82 is horizontally supported by a vertical supporting plate 84 which is supported on studs 83 projecting from the inner surface of the rear wall of the main body 1. The flange 81, which is interposed between the rear wall of the main body 1 and the supporting plate 84, maintains the pushbutton 8 in position relative to the main body 1. The free end of the pin 82 is received in a hole 85 pierced through the rear wall 31 of the motor housing 3. The hole 85 is tapered inwardly and guides the pin 82. A lever 87 for actuating the microswitch S is provided inwardly of the hole 85 as shown in FIGS. 4 through 6. The lever 87 is an L-shaped leaf spring having one end screwed down to a boss on the rear wall 31 of the motor housing 3, while the other end freely extends over an actuator 90 on the microswitch S. The bend of the lever 87 is located opposite to the free end of the pin 82, so that upon depression of the pushbutton 8, the pin 82 pushes the lever 87 inwardly to bring its free end into contact with the actuator 90 to turn on the microswitch S, whereby the motor M is started to rotate the cutter C. Discontinuation of the depression on the pushbutton 8 causes the lever 87 to move away from its operative contact with the microswitch S to stop the motor M. Upon detachment of the motor housing 3 from the main body 1, the operational connection between the lever 87 and the pin 82 on the pushbutton 8 is severed to disable the operation of the microswitch S and hence the motor M. The tapered configuration of the hole 85 ensures safety against any accidental movement of the lever 87 as it does not permit insertion of a finger.

The front wall of the motor housing 3 is provided with a hole 75 through which the fixed shaft 74 for the cutter C extends. The inner end of the fixed shaft 74 is received in a hole 77 pierced through a fixed plate 76 provided in the main body 1. The fixed shaft 74 is rotatable by turning the knob 72 to engage the lug 73 behind the fixed plate 76 to retain the cutter C with the main body 1. The knob 72 is rotatable by an angle of 90° in either direction.

The bottom wall of the motor housing 3 is formed with a plurality of holes 58. The bottom wall of the main body 1 is formed with a hole 89 extending over the holes 88. The holes 88 and 89 draw air to cool the motor M.

Figure 7:
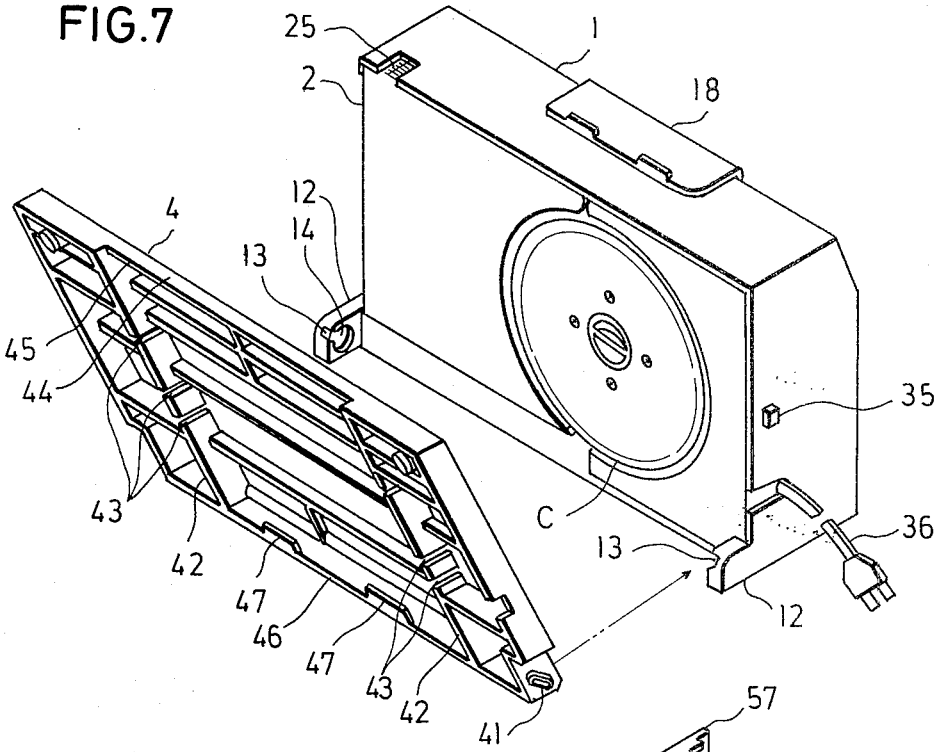
FIG. 7 is an exploded perspective view showing the plate support separated from the main body.

A plate support 4 is removably attached to the front face of the main body 1. The plate support 4 is pivotally connected to the main body 1, so that it is rotatable between a horizontal open position and a vertical closed position. As shown in FIG. 7, the main body 1 is provided at its lower end with a pair of horizontally projecting legs 12 each of which is formed on its inner surface with a circular groove 14 and an oblique guide groove 13 extending upwardly and outwardly from the circular groove 14.

A pair of lock pins 41 are provided on the opposite sides of the plate support 4. The lock pins 41 have an oval cross section and are inclined at an angle of about 45° with respect to the plane of the plate support 4. The lock pins 41 are movable along the guide grooves 13 and received in the circular grooves 14 to pivotally connect the plate support 4 to the front face of the main body 1. The lock pins 41 are rotatable within the circular grooves 14 to permit rotation of the plate support 4 between its horizontal position and its vertical position in which it faces the front face of the main body 1 in close proximity thereto. Because of the oblique orientation of the lock pins 41 and the guide grooves 13, the lock pins 41 are never disengaged from the circular grooves 14 either in the horizontal or vertical position of the plate support 4. Such disengagement is only possible when the plate support 4 is inclined at a certain angle to the main body 1.

The rear surface of the plate support 4 is provided with a plurality of stays, including a pair of vertical stays 42 each formed with a plurality of cord receiving slits 43 to hold the electric cord 36 neatly in a zigzag fashion. In its position shown in FIG. 9, the cord 36 functions to hold the plate support 4 against the accidental rotation.

The plate support 4 includes an outer frame 44 having an elongate recess 45 on the rear surface of the plate support 4. The inner frame 46 of the plate support 4 has a pair of small projections 47 directed toward the outer frame 44. The purposes of the recess 45 and the projections 47 will hereinafter be described.

Figure 10:
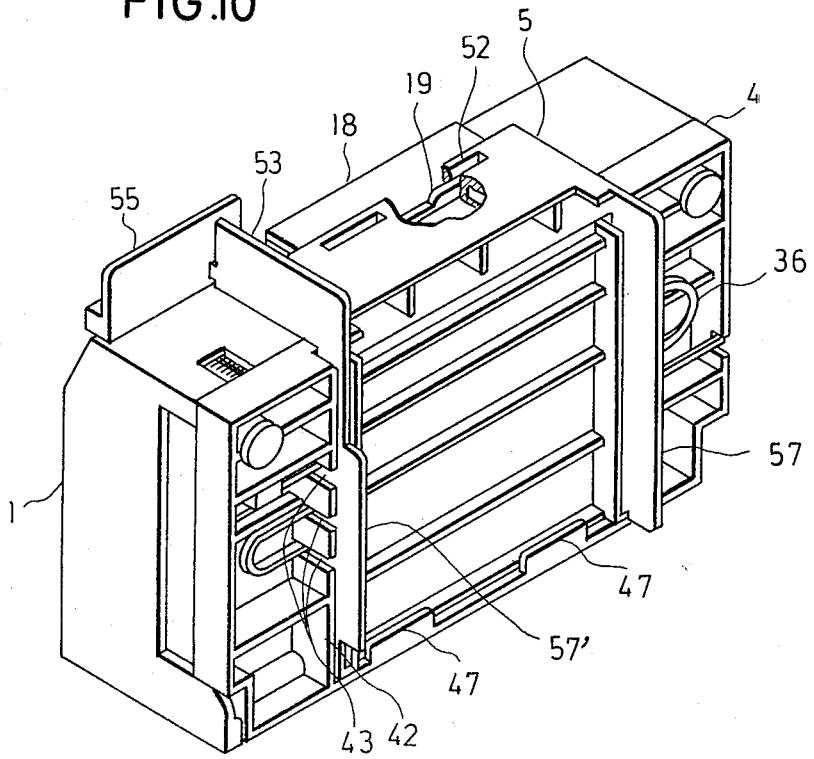
FIG. 10 is a perspective view in front elevation of the slicer which is ready for storage with all the parts held in a compact shape around the main body.
Figure 12:
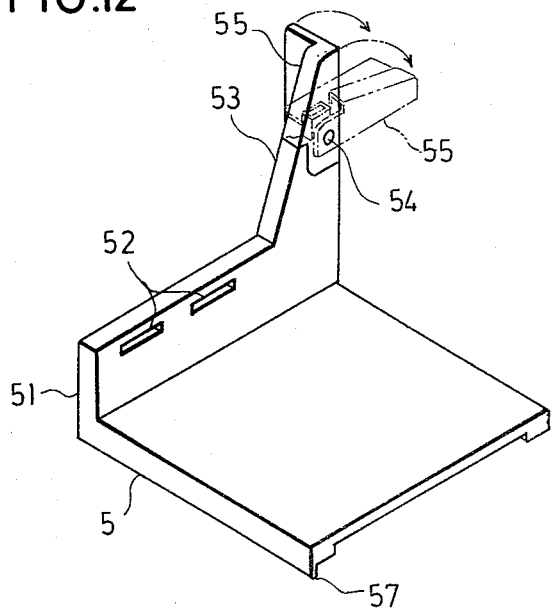
FIG. 12 is a perspective view of the slice plate.

A slice plate 5 is supported on the plate support 4 to feed the food to be sliced to the cutter C. The slice plate 5 is provided at its front and rear edges with a pair of downwardly projecting guide rails 57 and 57' engaging over the front and rear edges of the plate support 4 to enable the slice plate 5 to slide along the plate support 4 transversely of the machine. The left edge of the slice plate 5 as viewed in FIG. 1 has an upstanding flange 51. The flange 51 is provided at its rear end with an upwardly projecting arm 53 contacting the main body 1. The arm 53 supports the food to be sliced and feeds it to the cutter C. The arm 53 is provided at its upper end with a collapsible member 55 which is rotatable about a pin 54 into a perpendicular position relative to the arm 53 as shown in FIG. 12. The collapsible member 55 is bent into parallel relationship with the main body 1 without perpendicularly projecting therefrom when the machine is ready for storage, as shown in FIGS. 10 and 11.

Figure 8:
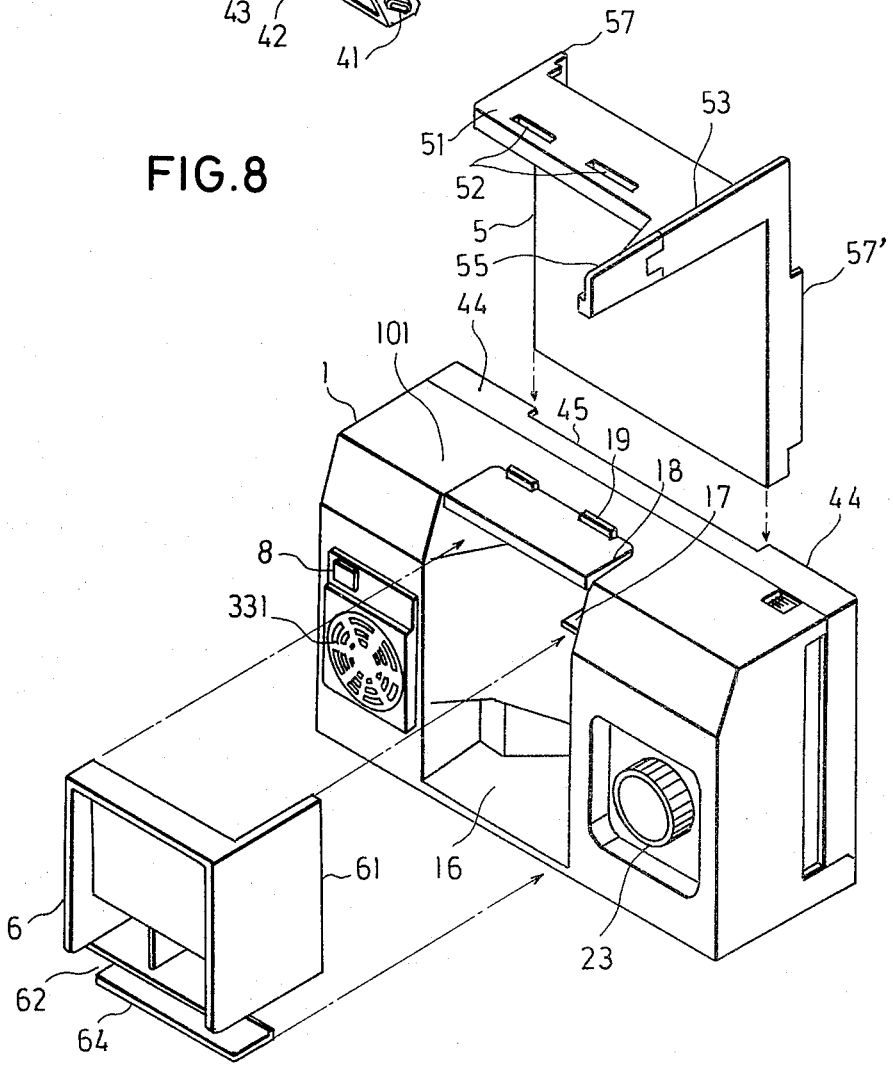
FIG. 8 is an exploded perspective view showing the slice plate and the food clamp as separated from the main body.

The flange 51 is provided with a pair of elongate slots 52 for the purpose which will hereunder be described. When the slice plate 5 is united with the main body 1 for the purpose of storage, the slice plate 5 is fitted in the recess 45 of the plate support 4 and the right-hand edge of the slice plate 5 is held by the projections 47 on the plate support 4. The slots 52 of the flange 51 are engaged with a pair of projections 19 formed on the handling portion 18 of the main body 1 as shown in FIGS. 8 and 10.

A food clamp 6 is supported on the slice plate 5 and provided with a groove 62 at its left-hand edge as viewed in FIG. 1. The groove 62 is engaged with the flange 51 of the slice plate 5 to guide the movement of the food clamp 6 along the flange 51 longitudinally of the machine. The food clamp 6 is provided at its rear edge with an upstanding clamping plate 61 which presses the food to be sliced against the front face plate 2.

The plate support 4, the slice plate 5 and the food clamp 6 are made of plastic.

In operation, the cord 36 is connected with a power source and the knob 23 is turned to move the front face plate 2 to set a desired slicing thickness on the scale 25. The food to be sliced is placed on the slice plate 5 and held against the front face plate 2 by the clamping plate 61 of the food clamp 6. Then, the slice plate 5 is moved toward the cutter C, whereby the food is sliced by the cutter C. The slices thus made are discharged through a hollow space 16 behind the cutter C.

At the end of each slicing operation, the electric food slicer must be washed for removal of any remaining liquid and smell of a particular food. In preparation for washing the machine, the food clamp 6 and the slice plate 5 are first detached from the plate support 4. The plate support 4 is detached from the main body 1 as the lock pins 41 are aligned with and moved along the guide grooves 13. In order to remove the cutter C, the knob 72 is turned to rotate the fixed shaft 74 to align the lug 73 with the hole 77 of the fixed plate 76, whereupon the cutter C and the fixed shaft 74 can be detached from the main body 1. Then, the lock button 35 is depressed and disengaged from the hole 38 of the main body 1, and the ventilation window 331 is pushed inwardly for disengagement thereof from the circular hole 332, whereby the motor housing 3 is separated from the main body 1.

With the machine thus disassembled, all the parts thereof, including the main body 1, except the motor housing 3, can be washed in a usual way. The motor housing 3 need not be washed because it does not contact any food to be sliced. The microswitch S is no longer actuated to operate the motor M, because the motor housing 3 is now severed from operational connection with the pushbutton 8 on the main body 1.

After all the parts except the motor housing 3 have been duly washed, the motor housing 3 is inserted into the main body 1 while the lock button 35 is kept depressed, and the ventilation window 331 is fitted in the circular hole 332 of the rear wall of the main body 1. The lock button 35 is engaged with the hole 38 of the side wall of the main body 1, whereby the motor housing 3 is secured in position within the main body 1.

The fixed shaft 74 for the cutter C is passed through the hole 75 of the motor housing 3. The driven gear 71 is meshed with the driving gear 32. The fixed shaft 74 is inserted into the hole 77 of the fixed plate 76. The knob 72 is turned by 90°, whereby the lug 73 on the fixed shaft 74 is rotated behind the fixed plate 76 to connect the shaft 74 with the main body 1. The shaft 74 also functions to provide a stronger support for the motor housing 3 on the main body 1.

Then, the plate support 4 is attached to the legs 12 on the main body 1 by insertion of the lock pins 41 into the circular grooves 14 through the guide grooves 13. The plate support 4 is roatated about the lock pins 41 into its vertical closed position.

Figure 9:
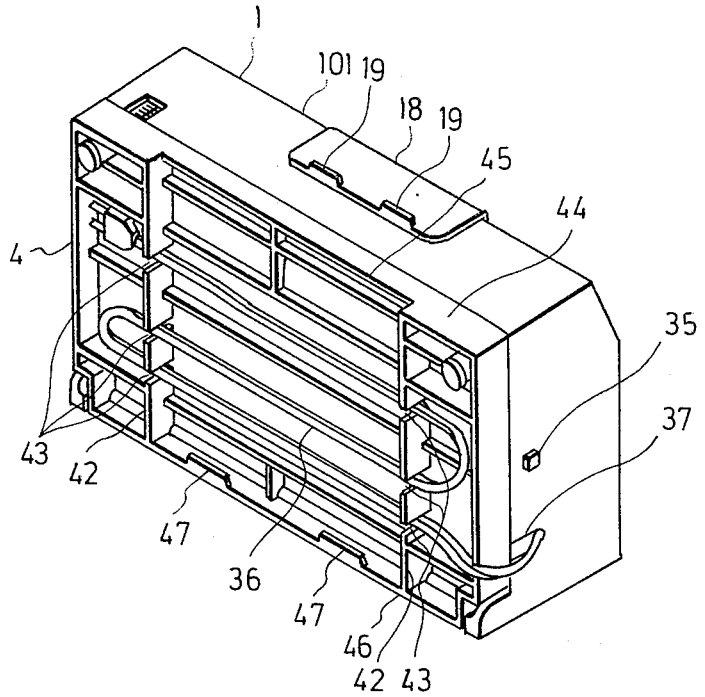
FIG. 9 is a perspective view showing an electric cord neatly held on the rear face of the plate support.

The electric cord 36 is bent in a number of turns and pushed in the cord receiving grooves 43 on the vertical stays 42 on the rear surface of the plate support 4. As shown in FIG. 9, the cord 36 or more particularly its root portion extending between the main body 1 and the plate support 4 serves to hold the plate support 4 against rotation into its open position.

The slice plate 5 is attached to the rear surface of the plate support 4. The upper surface of the slice plate 5 faces the plate support 4. As shown in FIG. 8, the slice plate 5 is fitted in the recess 45 and the lower edge of the slice plate 5 is engaged by the projections 47. The holes 52 of the flange 51 are engaged with the projections 19 on the top wall 101 of the main body 1. The collapsible member 55 on the arm 53 is turned about the pin 54 into parallel relationship with the main body 1 without projecting perpendicularly therefrom.

The food clamp 6 is accommodated in the hollow space 16 through which sliced food is discharged when the machine is in use. The food clamp 6 is held with its groove 62 down and its clamping plate 61 secured under a holding plate 17 projecting from the main body 1 into the hollow space 16 as shown in FIGS. 8 and 11.

The food clamp 6 includes an outer side plate 64 extending along the groove 62. It is a planar member made of plastic to which the groove 62 imparts elasticity. This elasticity of the outer side plate 64 permits the food clamp 6 to be securely held in position within the hollow space 16, as shown in FIG. 11.

Thus, the plate support 4, the slice plate 5 and the food clamp 6 are put together into a compact shape with the main body 1 when the machine is not in use. The machine, therefore, does not require a large space for storage. It also facilitates packing. A great number of electric food slicers of this invention can advantageously be transported or stored in a warehouse at one time. The machine can be kept in a sanitary condition when not in use, because all the food contacting surfaces face the interior of the machine, instead of being exposed to the exterior, when the parts are attached to the main body for storage purposes. The electric cord 36 does not interfere with any other part of the machine causing damage thereto, because it can be held in order within the slice plate 5.

While the invention has been described with reference to a preferred embodiment thereof, it is to be understood that modifications or variations may easily be made by a person of ordinary skill in the art without departing from the spirit and scope of this invention as defined by the appended claims.

What is claimed is:

1. An electric food slicer comprising:

a main body having a front wall, a rear wall, a top wall, a bottom wall and a pair of side walls;

a front plate defined by said front wall which is movable toward and away from said rear wall to adjust a slicing thickness;

a rotatable slicing cutter provided beside said front plate;

a motor housing removably received in said main body;

an electric motor in said motor housing for rotating said cutter;

means provided on said motor housing for locking it to said main body;

means provided on said rear wall of said main body for actuating a switch to start said motor;

a driving gear exposed in front of said motor housing and drivingly connected with said motor;

a driven gear integrally secured to said cutter and meshing with said driving gear;

a fixed shaft supporting said cutter rotatably, and having an outer end formed with a knob and an inner end provided with a lug;

means provided in said main body for engaging said inner end of said fixed shaft to removably support said cutter in front of said front wall;

a plate support removably and rotatably supported on said main body for rotation between a horizontal operative position and a vertical inoperative position in which said plate support faces said front plate and said cutter in close proximity thereto;

means for supporting said plate support on said main body, while allowing detachment of said plate support from said main body upon positioning of said plate support at a predetermined angle between said horizontal and vertical positions;

a slice plate removably supported on said plate support;

a food clamp removably supported on said slice plate;

an electric cord connected to said motor;

means provided on said plate support for holding said electric cord;

means provided on said top wall of said main body and said plate support for holding said slice plate, when not in use, on the outside of said plate support supported in said vertical position thereof;

said rear wall of said main body having an opening defining a hollow space through which sliced food is discharged, and in which said food clamp is accommodated when not in use; and means provided in said hollow space for holding said food clamp in position.

2. An electric food slicer as set forth in claim 1, wherein said slice plate includes an upright flange; said slice plate holding means comprises a pair of projections provided on said top wall of said main body, a pair of holes pierced through said flange to receive said projections therein, a pair of projections provided on said plate support to hold the edge of said slice plate remote from said flange and a recess provided in said plate support to receive said slice plate therein; and said food clamp includes an elastic outer side plate defining a groove engageable over said flange of said slice plate, said food clamp holding means comprising a holding plate projecting from said main body into said hollow space to hold said outer side plate elastically thereunder.

3. An electric food slicer as set forth in claim 1, wherein said cord holding means comprises at least one vertical stay provided on said plate support and having a plurality of slits through which said cord is passed in a zigzag fashion.

4. An electric food slicer as set forth in claim 1, wherein said motor housing locking means comprises a hole in one of said side walls of said main body, a lock button resiliently supported on said motor housing to normally engage in said hole, a circular ventilation window projecting from said motor housing, and a circular hole provided in said rear wall of said main body to receive said ventilation window therein; and said motor housing includes a switch for starting said motor; and said rear wall of said main body is provided with means for actuating said switch.

5. An electric food slicer as set forth in claim 4, wherein said motor housing includes a member for actuating said switch upon operation of said switch actuating means on said main body, and a tapered hole connecting the interior of said main body and the interior of said motor housing and tapered toward said interior of said motor housing; and said switch actuating means comprises a pushbutton provided on said rear wall of said main body, a pin secured to said pushbutton and movable through said tapered hole to push said switch actuating member into operational abutment on said switch upon depression of said pushbutton, and a member for supporting said pin horizontally in alignment with said tapered hole.

* * * * *